United States Patent [19]

Reimann

[11] 3,931,773

[45] Jan. 13, 1976

[54] ASH REMOVAL APPARATUS FOR COAL-DUST FIRING EQUIPMENT

[75] Inventors: Eberhard Reimann, Bunde, Germany

[73] Assignee: EVT Energie-und Verfahrenstechik GmbH, Stuttgart, Germany

[22] Filed: Dec. 13, 1974

[21] Appl. No.: 532,738

[30] Foreign Application Priority Data

Dec. 22, 1973 Germany ..... 2364366

[52] U.S. Cl. ..... 110/165 R; 110/171

[51] Int. Cl.[2] ..... F23J 1/00

[58] Field of Search ..... 110/165 R, 165 A, 171

[56] References Cited

UNITED STATES PATENTS

| | | | |
|---|---|---|---|
| 2,275,652 | 3/1942 | Pursel | 110/165 |
| 2,589,836 | 3/1952 | Martin | 110/165 |
| 3,133,804 | 5/1964 | Hardgrove | 110/165 |
| 3,589,317 | 6/1971 | Kunovits | 110/171 |

*Primary Examiner*—Kenneth W. Sprague

[57] ABSTRACT

An improved ash removal apparatus for coal-dust firing equipment which includes a firebox and a scraper-chain type conveyor including a water trough which is disposed below the ash outlet of the equipment firebox. A protective hood is coupled to and is communicative with the firebox outlet, and in addition, is positioned over the conveyor trough and extends thereinto. A plurality of floatable members which are rotatable about their own longitudinal axes, are disposed within the hood and float on the surface of the water contained in the conveyor trough so as to catch ashes falling from the firebox outlet on the surfaces thereof.

6 Claims, 3 Drawing Figures

ASH REMOVAL APPARATUS FOR COAL-DUST FIRING EQUIPMENT

BACKGROUND OF THE INVENTION

1. Field of the Invention

This invention relates generally to coal-dust firing equipment, and in particular to an improved ash removal apparatus for such equipment.

2. Description of the Prior Art

In the known prior art ash removal apparatus for coal-dust firing equipment (see, for example, German published text DAS 2,002,674), a scraper-chain conveyor is disposed below the firebox of the equipment and a protective hood, which is coupled to the firebox outlet, extends into the water trough of the conveyor in order to prevent the flow of air into the firebox outlet. The upper length of the scraper chain of the conveyor in such prior art apparatus usually moves above a stationary table provided with slots in the surface thereof which is disposed below the firebox ash outlet. The disadvantage of this apparatus, however, is that some of the ashes falling from the firebox outlet can pass through the slots unhindered into the water trough and cause explosions therein.

SUMMARY OF THE INVENTION

It is therefore an object of the invention to provide an improved ash removal apparatus for coal-dust firing equipment which overcomes the aforementioned disadvantage of heretofore known apparatus and which prevents an immediate immersion of large quantities of hot ashes in the quenching water contained in the conveyor trough of the apparatus before the cooling thereof.

These and other objects are achieved in the invention in an ash removal apparatus for coal-dust firing equipment which includes a firebox by the provision of a scraper-chain type conveyor including a water trough which is disposed below the ash outlet of the equipment firebox. A protective hood is coupled to and is communicative with the firebox outlet, and is disposed over and extends into the conveyor trough. A plurality of spaced-apart floatable members are disposed within the hood and are rotatable about their own longitudinal axes. The members float on the surface of the water contained in the trough and catch ashes which fall from the firebox outlet on the surfaces thereof. The weight of the falling ashes turns the members and causes the ashes on the surface thereof to be slowly immersed in the quenching water.

These and other features of the inventive apparatus will be discussed in further detail in the following detailed description.

DETAILED DESCRIPTON

Figure 1:
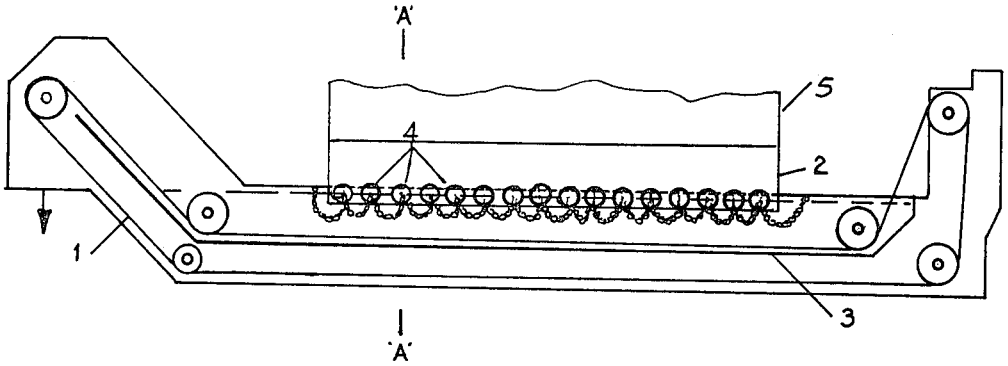
FIG. 1 is a longitudinal sectional view of an improved ash removal apparatus constructed according to the invention.
Figure 2:
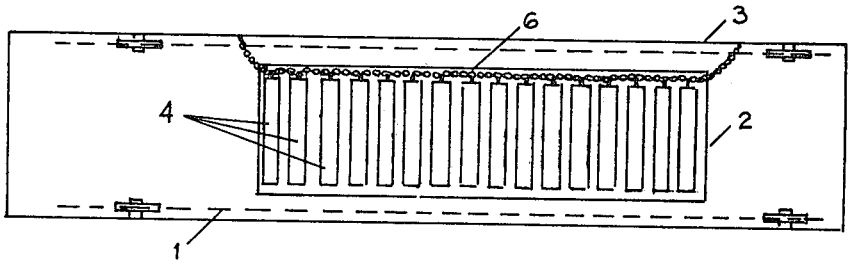
FIG. 2 is a top plan view of the inventive apparatus.
Figure 3:
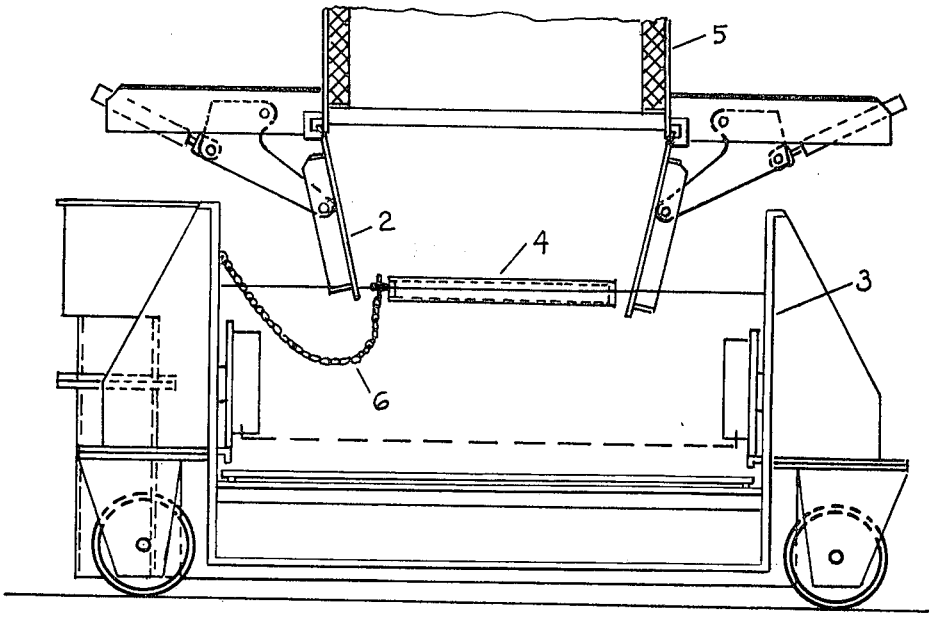
FIG. 3 is an enlarged, cross-sectional view of the apparatus taken along section A—A of FIG. 1.

Referring now to the drawings, there is shown an ash removal apparatus constructed according to the invention in which a scraper-chain conveyor 1, which includes a water trough 3, is disposed below the ash outlet 5 of the lower end of the ash funnel of the firebox (not shown) of the coal-dust firing equipment. A protective hood 2, which includes pivotable flaps which enable ash outlet 5 to be closed, is coupled to and is communicative with outlet 5 and is disposed over and extends into water trough 3. This extension of the hood into the trough water prevents the flow of air into the firebox of the equipment through outlet 5. A plurality of floatable members, illustrated as water-tight cylinders 4, are disposed within hood 2 in a spaced-apart arrangement and are rotatable about their own longitudinal axes. The cylinders float on the surface of the water in the trough within the hood and catch ashes which fall from outlet 5 on the surfaces thereof.

A carrying chain 6 is pivotably coupled to one end of each of cylinders 4, and has the ends thereof coupled to one of the walls of the water trough 3. This arrangement assures that the spaced-apart arrangement of the cylinders is maintained and also enables the spacing between the cylinders to be specified to suit the maximum amount of ash falling from outlet 5. The length of chain 6 which is disposed within hood 2 is preferably greater than the length of the hood, since this enables the cylinders to adapt their spacing to larger fragments of ash and avoids the need for comminution of such fragments. Cylinders 4 are also preferably disposed within hood 2 so that the longitudinal axes thereof are directed perpendicular to the direction of conveyance of conveyor 1. This assures that the falling ashes will be distributed over the surfaces of several of the cylinders so that the amount of ash falling into the quenching water at one time is small. The danger of explosion is thereby eliminated.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An improved ash removal apparatus for coal-dust firing equipment including a firebox having an ash outlet, comprising:

a scraper-chain conveyor including a water trough disposed below an said ash outlet of said firebox;

a hood, coupled to and communicative with said firebox outlet, disposed over and extending into said conveyor trough; and a plurality of spaced apart floatable members, disposed within said hood and rotatable about their own longitudinal axes, for floating on the surface of the water contained in said trough within said hood and catching ashes falling from said firebox outlet on the surfaces thereof.

2. The apparatus recited in claim 1, wherein said floatable members each comprise a hollow, water-tight cylinder.

3. The apparatus recited in claim 2, wherein said floatable members are disposed within said hood so that the longitudinal axes thereof are disposed perpendicular to the direction of conveyance of said conveyor.

4. The apparatus recited in claim 3, wherein said floatable members are coupled to a wall of said scraper-chain conveyor trough.

5. The apparatus recited in claim 3, wherein said floatable members further comprise at least one carrying chain coupled to at least one end thereof and to at least one wall of said conveyor trough.

6. The apparatus recited in claim 5, wherein a portion of said carrying chain is disposed within said hood and the length of said portion therewithin is greater than the length of said hood.

* * * * *

UNITED STATES PATENT OFFICE

CERTIFICATE OF CORRECTION

Patent No. 3,931,773 Dated January 13, 1976

Inventor(s) Eberhard Reimann, et al

It is certified that error appears in the above-identified patent and that said Letters Patent are hereby corrected as shown below:

In claim 1, column 2, line 49, delete "an".

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*